US006226469B1

(12) United States Patent
Suzuki et al.

(10) Patent No.: US 6,226,469 B1
(45) Date of Patent: May 1, 2001

(54) SYSTEM FOR REDUCING TONER SCATTERING

(75) Inventors: Takehiko Suzuki, Numazu; Toshiaki Miyashiro, Shizuoka-ken; Takaaki Tsuruya, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/128,539

(22) Filed: Aug. 4, 1998

(30) Foreign Application Priority Data

Aug. 4, 1997 (JP) ..... 9-209496
Jul. 21, 1998 (JP) ..... 10-205083

(51) Int. Cl.[7] ..... G03G 15/00; G03G 15/01; G03G 15/16

(52) U.S. Cl. ..... 399/66; 399/44; 399/48; 399/50; 399/302

(58) Field of Search ..... 399/46, 48, 50, 399/66, 49, 44, 302, 298, 314, 98, 101, 127, 128, 234, 235

(56) References Cited

U.S. PATENT DOCUMENTS 3,788,739 * 1/1974 Coriale ..... 399/48
4,984,026 * 1/1991 Nishise et al. ..... 399/302
5,270,783 * 12/1993 Bisaiji et al. ..... 399/48 X
5,357,330 * 10/1994 Hauser ..... 399/302
5,515,140 * 5/1996 Atsumi et al. ..... 399/48
5,552,861 * 9/1996 Mizude et al. ..... 399/50
5,640,645 * 6/1997 Namekata et al. ..... 399/66
5,737,665 * 4/1998 Sugiyama et al. ..... 399/44 X
5,794,111 * 8/1998 Tombs et al. ..... 399/302
5,838,456 * 11/1998 Wagi et al. ..... 399/302 X
5,842,081 * 11/1998 Kaname et al. ..... 399/50
5,852,756 * 12/1998 Teranishi et al. ..... 399/44
5,887,218 * 3/1999 Yuu et al. ..... 399/44
5,946,538 * 8/1999 Takeuchi et al. ..... 399/302
5,950,058 * 9/1999 Kusaba et al. ..... 399/302

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes an image bearing member, an image forming device for sequentially forming toner images of different colors on the image bearing member, the image forming device including a charging member for electrically charging the image bearing member to a polarity which is the same as a regular charging polarity of the toner. The apparatus also includes an intermediary transfer member having a volume resistivity of $10^{10}$–$10^{16}\Omega\cdot$cm, an image transferring device for applying a voltage to the intermediary transfer member to transfer electrostatically, sequentially, and superimposedly the toner images of the different colors formed on the image bearing member by the image forming means onto the intermediary transfer member, wherein toner images on the intermediary transfer member are transferred onto a transfer material, and a control device for controlling a voltage applied to the charging member, the control device controlling the voltage applied to the intermediary transfer member by the image transferring device in accordance with the voltage applied to the charging member.

81 Claims, 10 Drawing Sheets

| | 1ST | 2ND | 3RD | 4TH |
|---|---|---|---|---|
| LATITUDE OF IRY CHARGING | 380V | 260V | 210V | 170V |

SYSTEM FOR REDUCING TONER SCATTERING

FIELD OF THE INVENTION AND RELATED ART

The present invention relates to an electrophotographic image forming apparatus such as a copying machine or a printer.

FIG. 12 shows a typical conventional image forming apparatus.

A photosensitive drum 101 is rotatively driven. After being uniformly charged to the negative polarity by a primary charging device 102, the peripheral surface of the photosensitive drum 101 is exposed to a laser beam 103. As a result, an electrostatic latent image which reflects image data is formed. The electrostatic latent image is developed in reverse into a toner image by a developing device. More specifically, developing devices 104*a,* 104*b,* 104*c* and 104*d,* which contain negatively chargeable yellow, magenta, cyan and black toners, respectively, are mounted in a rotary 104, which is rotatable about its axis to position one of the developing devices, that is, the developing device for developing the electrostatic latent image currently present on the peripheral surface of the photosensitive drum 101, at the latent image developing zone where the peripheral surface of the developing device squarely faces the peripheral surface of the photosensitive drum 101. For example, in order to develop the electrostatic latent image correspondent to the yellow component of the image to be formed, the rotary 104 is rotated to position the yellow color developing device 104 at the latent image developing point so that yellow toner is adhered to the latent image, that is, to develop the latent image into a yellow toner image.

The thus formed yellow toner image is transferred (primary transfer), in a primary transfer station 106*a,* onto an intermediary transfer belt 105 by applying primary transfer bias to a primary transfer roller 109. The toner which remains on the peripheral surface of the photosensitive drum 101 after the primary transfer process is removed by a cleaning apparatus 107.

The aforementioned charging process, exposing process, developing process, primary transfer process, and cleaning process are carried out for the rest of the color components, that is, magenta, cyan, and black color components. As a result, four toner images of different color are overlaid on the intermediary transfer belt 105.

Then, the four color toner images are transferred (secondary transfer) all at once in a secondary transfer station 106*b* by a secondary transfer roller 110, onto a transfer medium P, which is conveyed from a sheet feeding station (unillustrated).

After the secondary transfer process, the transfer medium P is conveyed to a fixing apparatus (unillustrated), in which the four color toner images are fixed to the surface of the transfer medium P by heat and pressure. Then, the transfer medium P is discharged into a delivery tray (unillustrated).

The toner which remains on the intermediary transfer belt 105 after the secondary transfer process is removed by a cleaner 108.

Some of the image forming apparatuses are provided with a mechanism which automatically controls the magnitude of the development bias applied to the developing sleeves of the developing devices 104*a,* 104*b,* 104*c* and 104*d,* in order to adjust image density so that image quality is improved. In such an image forming apparatus, charge bias applied to the primary charging device 102 is also varied in magnitude in accordance with the magnitude of the development bias.

However, as the primary charge bias is varied as described above, toner is scattered, detrimentally affecting the final image in terms of color accuracy; degrading the image quality, in particular, in the areas of the image in which the toner images of different color are literally overlaid. This is thought to occur due to the following reason. That is, if the difference between the electrical potential level to which the photosensitive drum 101 has been charged and the voltage level of the primary transfer bias becomes excessive, it becomes impossible for a proper image transfer electric field to be formed; electrical discharge occurs in the non-image portion, detrimentally affecting the image transfer process. On the other hand, if the aforementioned difference is excessively small, not only does a proper transfer electric field fail to be formed, but also it becomes impossible to give electrical charge even to the non-image portion of the intermediary transfer belt 105 during the processes in which the toner images of different color are overlaid on the intermediary transfer belt 105, and therefore, it becomes impossible to form a barrier composed of electrical potential, to prevent toner from scattering. As a result, images are inaccurately formed in terms of color.

SUMMARY OF THE INVENTION

The object of the present invention is to provide an image forming apparatus capable of preventing toner particles from scattering from the toner images after the toner images are transferred from an image bearing member onto an intermediary transfer member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinafter, the embodiments of the present invention will be described with reference to the drawings.

Embodiment 1

Figure 1:
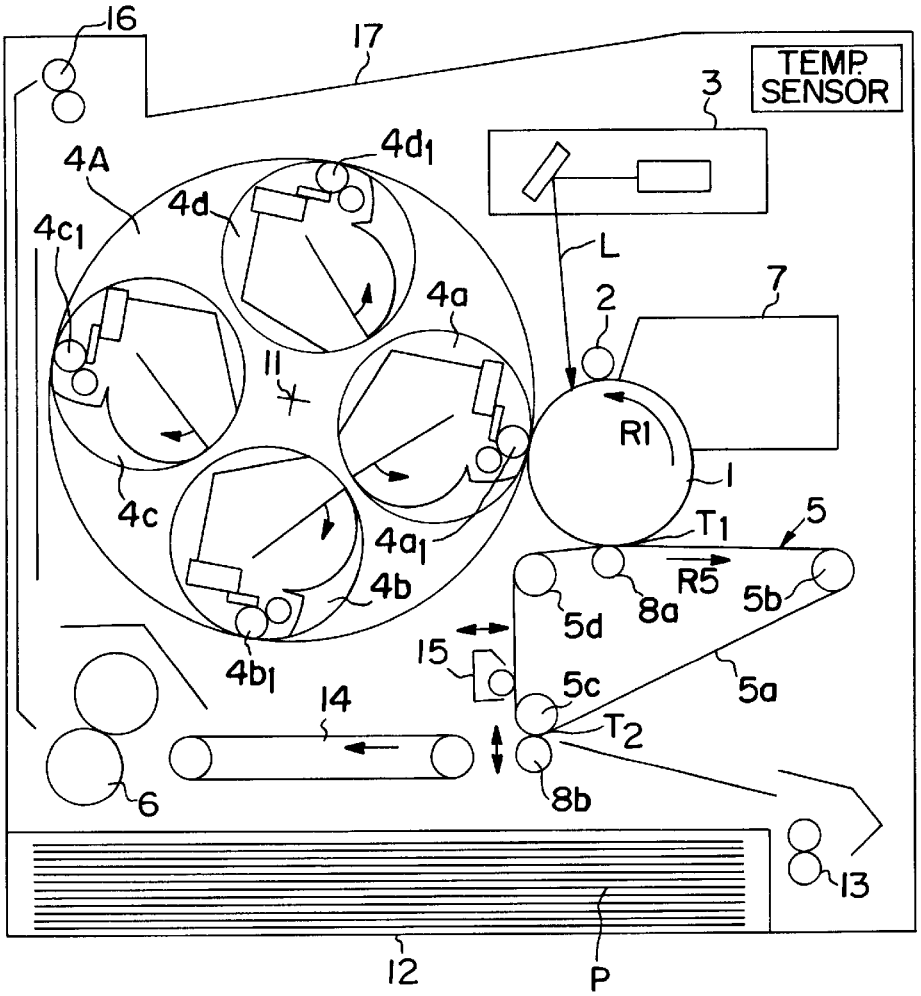
FIG. 1 is a schematic vertical section of the image forming apparatus in the first embodiment of the present invention, and depicts the general structure of the apparatus.

FIG. 1 is a schematic vertical section of an image forming apparatus in accordance with the present invention, and depicts the general structure of the apparatus. The apparatus in this drawing is a laser beam printer based on four primary colors, and is capable of forming full-color images.

The laser beam printer (hereinafter, "image forming apparatus") in this drawing is provided with a cylindrical electrophotographic photosensitive member (hereinafter, "photosensitive drum") as an image bearing member. The photosensitive drum 1 is rotatively driven in the direction indicated by an arrow mark R1 by a driving means (unillustrated).

The peripheral surface of the photosensitive drum 1 is uniformly charged to a predetermined potential level as a predetermined negative primary charge bias is applied to a primary charger 2, as a charging member, by a power source 20. After the charging process, the peripheral surface of the photosensitive drum 1 is exposed to a laser beam L projected from an exposing apparatus 3 while being modulated with the image formation data for the yellow component of the image to be formed. As a result, the electrical charge is removed from the exposed portion of the peripheral surface of the photosensitive drum 1; an electrostatic latent image is formed.

As the photosensitive drum 1 is rotated further in the arrow R1 direction, the exposed portion of the peripheral surface of the photosensitive drum 1 reaches the development point. Meanwhile, a yellow color component developing device 4*a,* which is one of four developing devices 4*a,* 4*b,* 4*c* and 4*d,* being mounted on a rotary supporting member 4A and containing yellow, magenta, cyan and black toners, respectively, is positioned at the development point by the rotation of the rotary supporting member 4A. At the development point, the peripheral surfaces of the developing device 4*a* an the photosensitive drum 1 squarely face each other, and a predetermined development bias is applied to a development sleeve 4*a*1, which is one of the development sleeves 4*a*1, 4*b*1, 4*c*1 and 4*d*1, of the developing devices 4*a,* 4*b,* 4*c* and 4*d,* respectively. As a result, the electrostatic latent image on the photosensitive drum 1 is developed into a yellow toner image. The normal charge polarity of toner is negative.

The toner image on the photosensitive drum 1 is transferred (first transfer) onto an intermediary transfer belt 5*a,* as an intermediary transfer member, by a combination of a power source 19 and a first transfer roller 8*a,* as a transferring means. The intermediary transfer belt 5*a* is stretched around three rollers 5*b,* 5*c* and 5*d,* and constitutes an intermediary transferring apparatus 5 together with the three rollers. The intermediary transfer belt 5*a* is rotated in the direction indicated by an arrow mark R5 at substantially the same velocity as the photosensitive drum 1, and as the predetermined primary transfer bias (positive) is applied to the first transfer roller 8*a* by the power source 19, at a first transfer nip $T_1$ as the first transfer point, the toner image, which has been formed, and borne, on the photosensitive drum 1, is transferred (first transfer) onto the surface of the intermediary transfer belt 5*a.*

After the first transfer process, the toner which is remaining on the peripheral surface of the photosensitive drum 1 is removed by a cleaning apparatus 7.

The aforementioned sequence of processes, that is, the charging, exposing, developing, first transferring, and cleaning process, is carried out for the rest of the color components, that is, three color components (magenta, cyan and black) one after another. As a result, four toner images of different color are overlaid on the intermediary transfer belt 5*a.*

Meanwhile, a transfer medium P is fed from a sheet feeder cassette 12 into the image forming apparatus by a pickup roller 13, and is delivered, with a predetermined timing, to a second transfer point $T_2$, where a second transfer roller 8*b,* which is kept slightly away from the intermediary transfer belt 5*a* when it is not transferring images, faces the intermediary transfer belt 5*a.* In transferring images, the second transfer roller 8*b* is placed in contact with the intermediary transfer belt 5*a* by an unillustrated mechanism, and a predetermined second transfer bias (positive) is applied to the second transfer roller 8*b* by a power source 21. As a result, the four toner color images of different color are transferred (second transfer) all at once from the intermediary transfer belt 5*a* onto the transfer medium P. During this second transfer process, a constant current power source is used as the power source 21 to keep constant the current which flows through the second transfer roller 8*a.*

After the second transfer process, the transfer medium P is conveyed to a fixing apparatus 6 by a conveyer belt 14. In the fixing apparatus 6, the toner images are fused to the transfer medium P, creating a permanent full-color image, Then, the transfer medium P is discharged from the fixing apparatus 6 into a delivery tray 17 by a discharging roller 16. The toner, which is remaining on the intermediary transfer belt 5*a* after the second transfer process, is removed by an intermediary transfer belt cleaner 15, which can be placed in contact with the intermediary transfer belt 5*a* or kept a small distance away from the intermediary transfer belt 5*a.*

Figure 2:
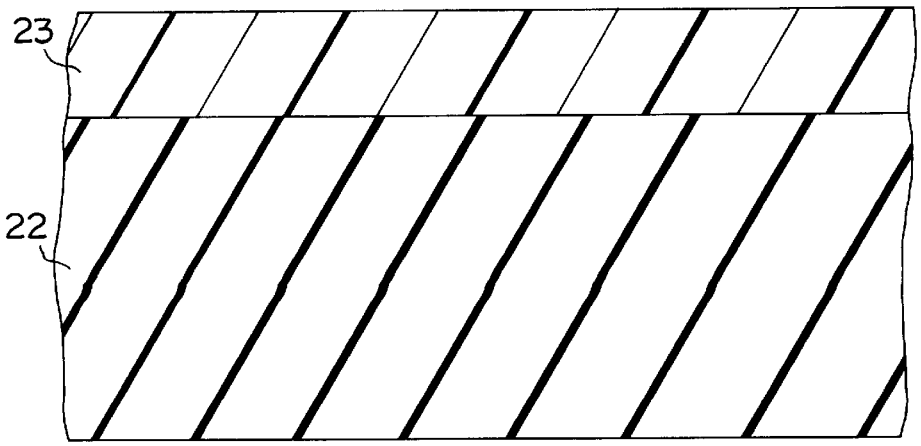
FIG. 2 is a section of the intermediary transfer belt in the first embodiment of the present invention, and depicts the structure of the intermediary transfer belt.

Next, the intermediary transfer belt 5*a* will be described with reference to FIG. 2.

The intermediary transfer belt 5*a* is constituted of an approximately 1 mm thick elastic layer 22, an an approximately 30 $\mu$m thick dielectric layer 23 coated on the elastic layer 22. The volumetric resistivity of the elastic layer is in a range of $10^3$–$10^8$ ohm·cm (preferably, $10^6$–$10^7$ ohm·cm), and the volumetric resistivity of the dielectric layer is in a range of $10^{10}$–$10^{16}$ ohm·cm (preferably, $10^{13}$–$10^{14}$ ohm·cm, in consideration of the attenuation of electric charge from the intermediary transfer belt 5*a*). The overall volumetric resistivity of the intermediary transfer belt 5*a* in terms of its thickness direction is in a range of $10^{10}$–$10^{16}$ ohm·cm (preferably, $10^{13}$–$10^{14}$ ohm·cm).

Next, a method for measuring the volumetric resistivity of the intermediary transfer belt 5*a* will be described.

First, a sample of the intermediary transfer belt 5*a* is cut into a 10 cm square piece, and the volumetric resistivity of this piece is measured using a resistance meter R8340A (product of Advantest Co., Ltd.), the main electric diameter of which is 50 mm, the internal diameter of the guard ring of which is 70 mm, and the external diameter of the guard ring of which is 80 mm. The ambience in which the measurement should be made is 22° C.–23° C. in temperature, and 50–60% RH in humidity, and the sample is left in this ambience for more than 24 hours before it is measured.

In measuring the volumetric resistivity of the dielectric layer 23, the material for the dielectric layer 23 is coated on a piece of aluminum sheet to a thickness of 15–40 $\mu$m, and then, a 10 cm square piece is cut out of this aluminum sheet covered with the dielectric material. Then, the volumetric resistivity of this 10 cm square piece is measured using the aforementioned resistance meter R8340A.

The first embodiment of the present invention is characterized in that the magnitude of the primary charge bias is varied in accordance with the properties (for example, the potential level to which each toner is chargeable) of each color toner, and then, the magnitude of the primary transfer bias is varied in accordance with the magnitude of the primary charge bias.

When a color image is formed by overlaying a plurality of color toner images of different color (magenta, cyan, yellow and black toner images) on the intermediary transfer belt 5*a,* there is a problem specific to such an image forming method; toner is scattered as the toner images are overlaid. For example, when yellow toner and magenta toner must be overlaid to form an image of red color, both the yellow toner image and the magenta toner image must be optimally transferred in terms of toner scattering. More specifically, as the electrical potential level of the non-image area on the intermediary transfer belt 5*a* becomes smaller than that of the image area on the intermediary transfer belt 5*a,* the strength of the barrier composed of electrical charge does not become sufficient, and as a result, toner is scattered. Therefore, in order to prevent the toner from scattering, it is necessary to give the non-image portion a sufficient amount of electrical charge.

Further, the first transfer process is sequentially repeated four times to form a full-color image, and therefore, the electrical charge given to the non-image area during the first primary transfer process attenuates as the first transfer process is sequentially carried out for the second and third times.

Further, in order to keep development constant (maintain an optimum toner density), the magnitude of the development bias is controlled in accordance with the ambient temperature and humidity detected by the temperature sensor and the humidity sensor provided within the image forming apparatus, and also in accordance with the number of copies which have been made prior to the copies being currently made in the current image forming operation. Then, the magnitude of the primary charge bias is changed in accordance with the development bias.

As the magnitude of the primary charge bias is changed, the potential level $V_D$ (dark portion potential level) of the peripheral surface of the photosensitive drum 1 changes, and therefore, the difference in voltage between the potential level $V_D$ and the primary transfer bias changes, which in turn changes the transfer current at the non-image area. As a result, the strength of the aforementioned barrier composed of electrical charge becomes insufficient, failing to prevent toner from scattering from the overlaid toner images. Consequently, an image is improperly formed in terms of color accuracy. Therefore, in this embodiment, in order to prevent this problem, the magnitude of the primary transfer bias is changed in accordance with the potential level $V_D$ of the peripheral surface of the photosensitive drum 1.

Figure 3:
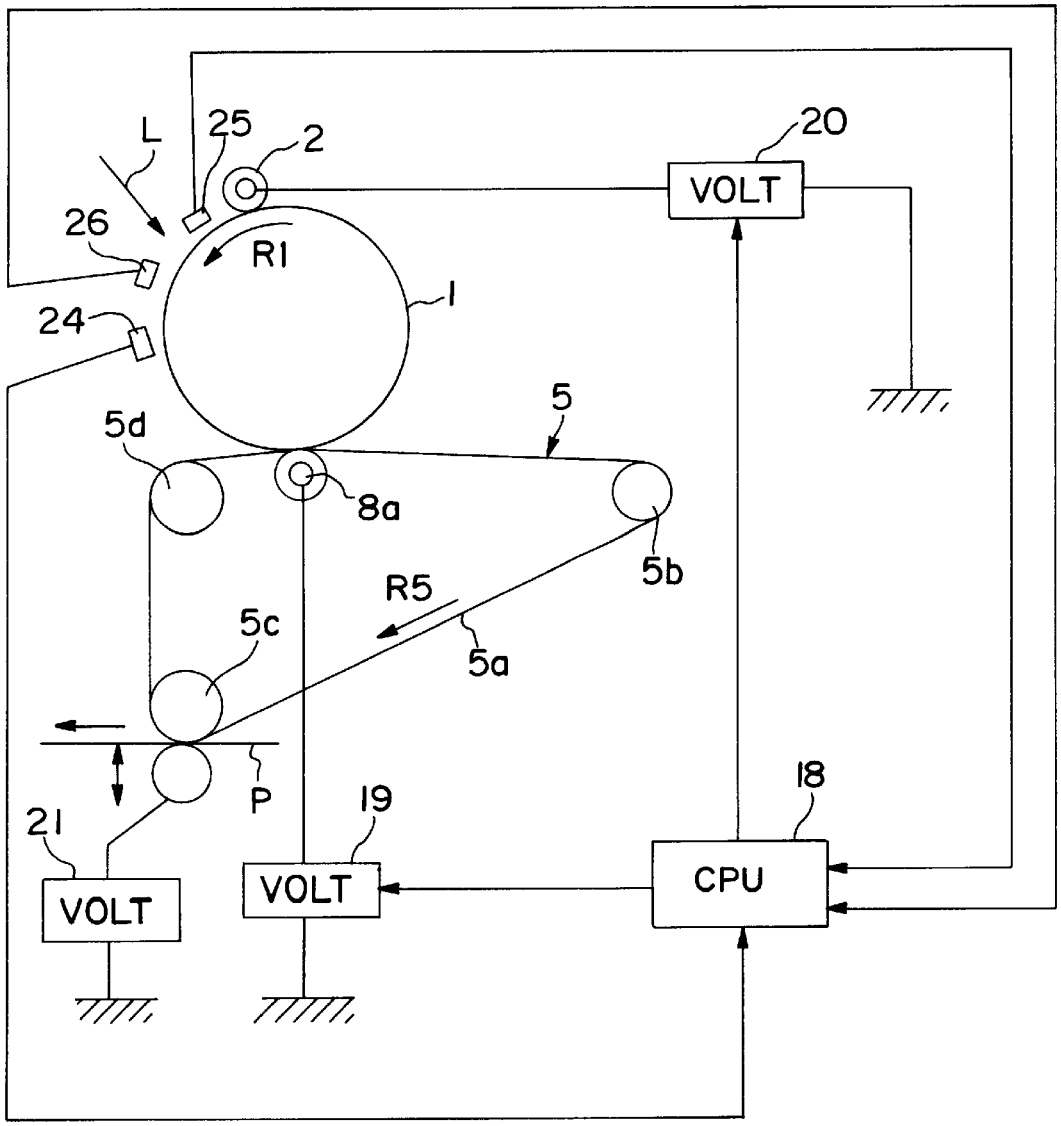
FIG. 3 is an enlarged section of the essential portion of the image forming apparatus depicted in FIG. 1.
Figure 4:
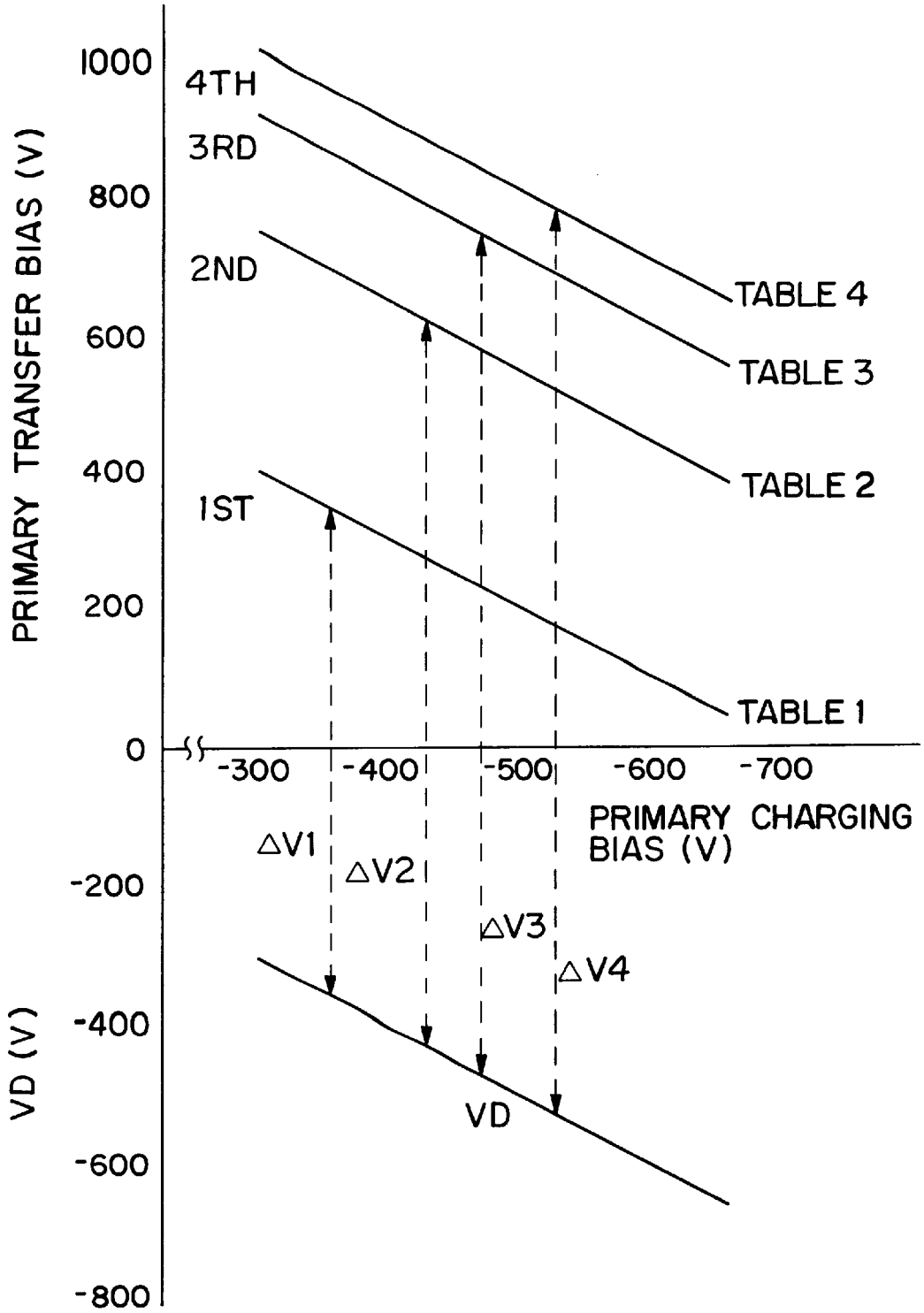
FIG. 4 is a graph which shows the relationship among the primary charge bias level, a potential level $V_D$ to which the photosensitive drum 1 is charged, and the level of the primary transfer bias, in the first embodiment.

Referring to FIG. 3, in this first embodiment of the present invention, a primary charge bias power source 20 is connected to a primary charge roller 2, and a primary transfer bias power source 19 is connected to the first transfer roller 8*a.* These power sources, the primary charge bias power source 20 and the primary transfer bias power source 19, are controlled by a CPU 18 (controlling means); they are turned on and off by the CPU 18, and the voltages applied from them are also controlled by the CPU 18. More specifically, referring to FIG. 4, the CPU 18 is provided with such tables that show the proper relationship in terms of the magnitude between the primary charge bias and the primary transfer bias, and changes the magnitude of the primary transfer bias in accordance with the magnitude of the primary charge bias so that the difference in voltage (ΔV1–ΔV4) between the potential level $V_D$ and the primary transfer bias remains substantially constant, individually, for each color component. The number of tables is correspondent to the number of color components, and therefore, there are four tables: Table 1–Table 4. Since the relationship between the magnitude of the primary charge bias and the potential level $V_D$ to which the photosensitive drum 1 is charged is known through the studies done by the inventors of the present invention, or the like, the primary transfer bias is changed in accordance with the primary charge bias.

According to the above arrangement, even if the potential level $V_D$ changes in accordance with the change in the primary charge bias, the difference in voltage between the potential level $V_D$ and the primary transfer bias can be kept constant, and therefore, toner is prevented from scattering.

In the description of the first embodiment of the present invention given above, the present invention was described with reference to the intermediary transfer belt 5*a,* that is, an intermediary transfer member in the form of a belt. However, similar effects can be obtained with the use of an intermediary transfer member in the form of a drum, which is constituted of a cylinder of aluminum or the like material, and a layer, similar to the layer of the intermediary transfer belt 5*a,* coated on the peripheral surface of the aluminum cylinder.

In such a case that the relationship between the primary charge bias and the potential level $V_D$ becomes different due to the magnetization or the like of the photosensitive drum 1, the potential level $V_D$ of the peripheral surface of the photosensitive drum 1 detected by the surface potential sensor 25 may be fed back to the CPU 18.

Embodiment 2

The description of the second embodiment of the present invention will be focused upon only such points of the second embodiment that render the second embodiment different from the first embodiment.

Figure 5:
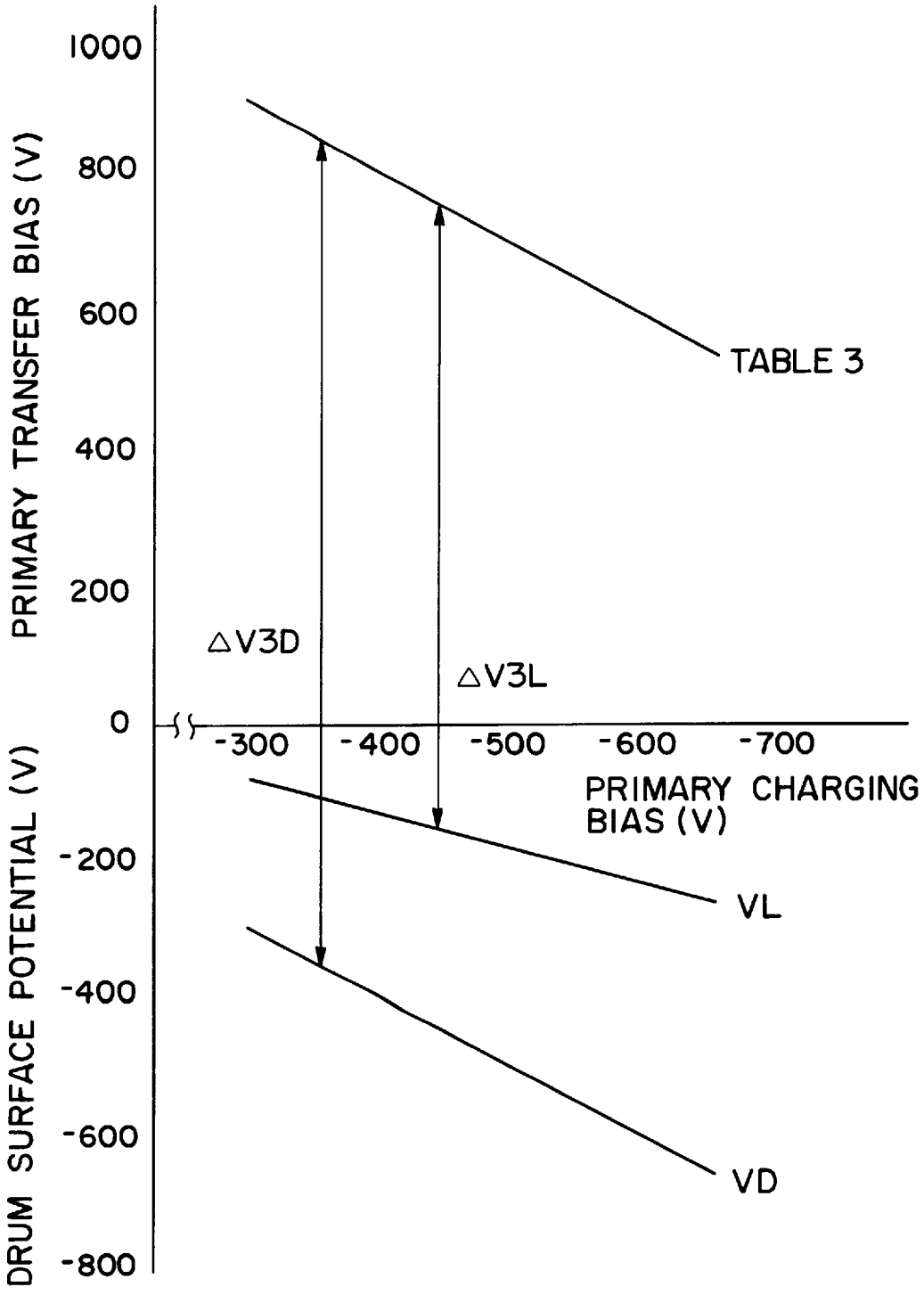
FIG. 5 is a graph which shows the relationship, or difference, among the potential level $V_D$ to which the photosensitive drum 1 is charged, a potential level $V_L$ of an exposed portion of the peripheral surface of the photosensitive drum 1, and the voltage level of the primary transfer bias, in the first embodiment.
Figure 6:
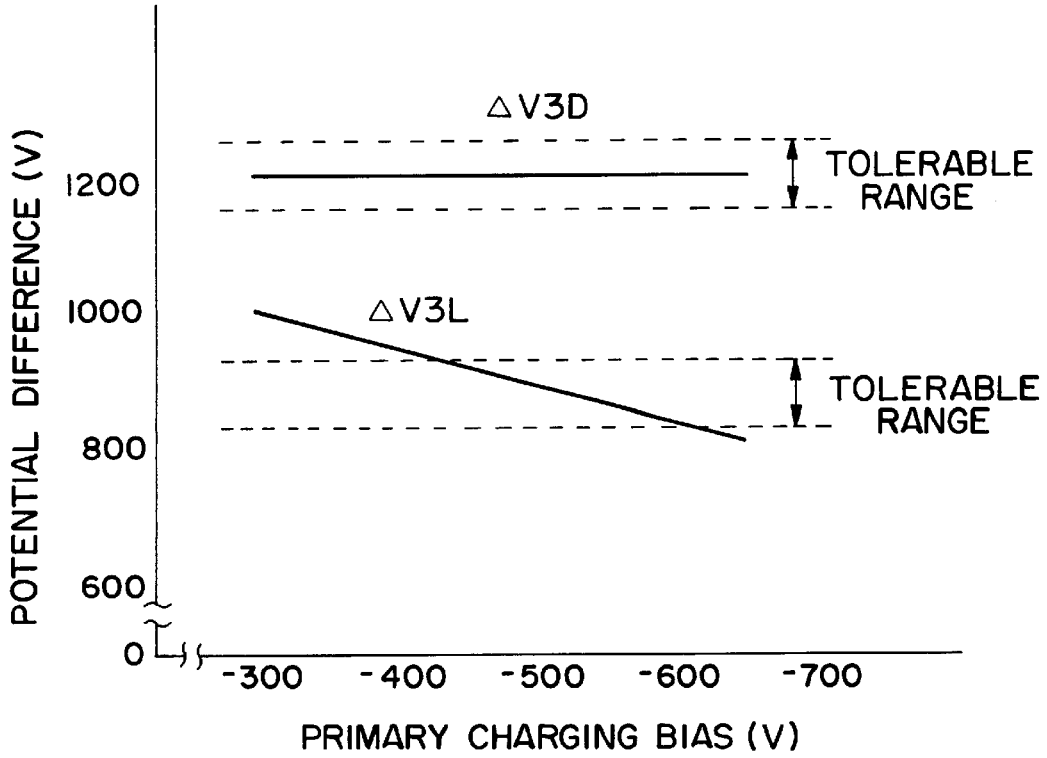
FIG. 6 is a graph which shows the relationship between the potential level $V_D$ to which the photosensitive drum 1 is charged, and its tolerable range, in the first embodiment.

In the first embodiment, control was executed to keep substantially constant the difference between the potential level $V_D$ to which the photosensitive drum 1 was charged, and the level of the primary transfer bias. However, the amount of the change which occurred to the potential level $V_D$ (dark point potential level) when the primary charge bias was changed, was different from the amount of the change which occurred to the potential level $V_L$ of the exposed portion (light point potential level) when the primary charge bias was changed, as shown in FIG. 5. Therefore, the difference in voltage between the potential level $V_L$ of the exposed portion and the level of the primary transfer bias did not remain constant. As a result, such problems as transfer failure or the scattering of toner occurred when the magnitude of the primary charge bias was near the top and bottom ends of the primary charge bias range. For example, if the difference $\Delta V3_D$ in voltage between the potential level $V3_D$ for the third color component and the magnitude of the primary transfer bias is rendered constant, the difference $\Delta V3_L$ between the potential level $V3_L$ of the exposed portion and the magnitude of the primary charge bias falls outside the tolerable range, near the top and bottom ends of the primary charge bias range, as shown in FIG. 6, and as a result, the strength of the barrier composed of electrical charge does not become sufficient, allowing toner to scatter and/or causing transfer failure.

Thus, in this second embodiment, the magnitude of the primary transfer bias is changed so as to minimize both the amount of the change which occurs to the difference in voltage between the potential level $V_D$ and the primary transfer bias when the primary charge bias is changed, and the amount of the change which occurs to the difference in voltage between the potential level $V_L$ of the exposed portion and the primary transfer bias. Since the relationship among the primary charge bias, the potential level $V_D$ to which the photosensitive drum 1 is charged, and the potential level $V_L$ of the exposed portion is known through the studies conducted by the inventors of the present invention, or the like, the primary transfer voltage can be controlled in accordance with the voltage of the primary charge bias.

Figure 7:
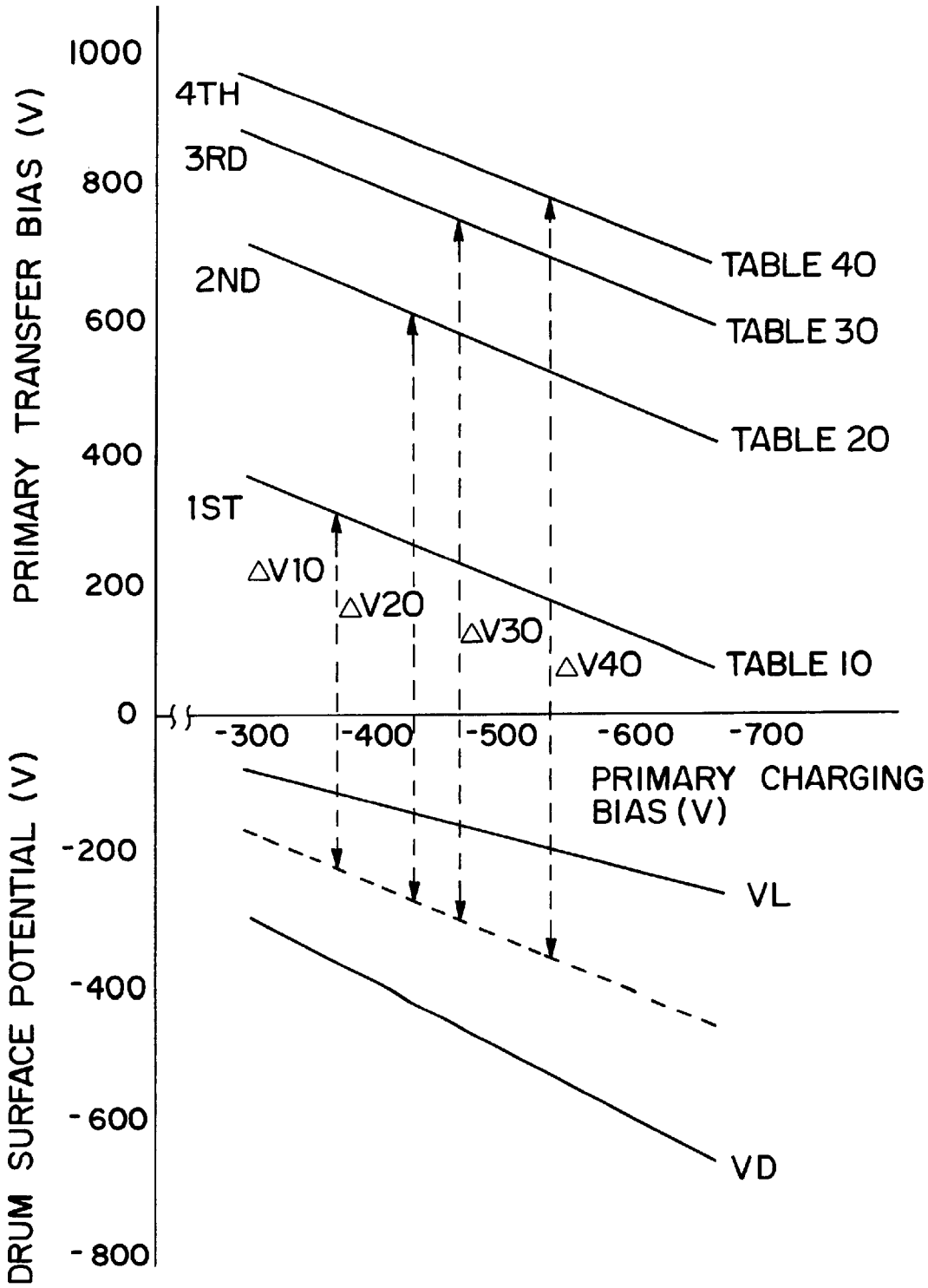
FIG. 7 is a graph which shows the relationship among the voltage level of the primary charge bias, the potential level $V_D$ to which the photosensitive drum 1 is charged, and the level of the primary transfer bias, in the second embodiment.
Figure 8:
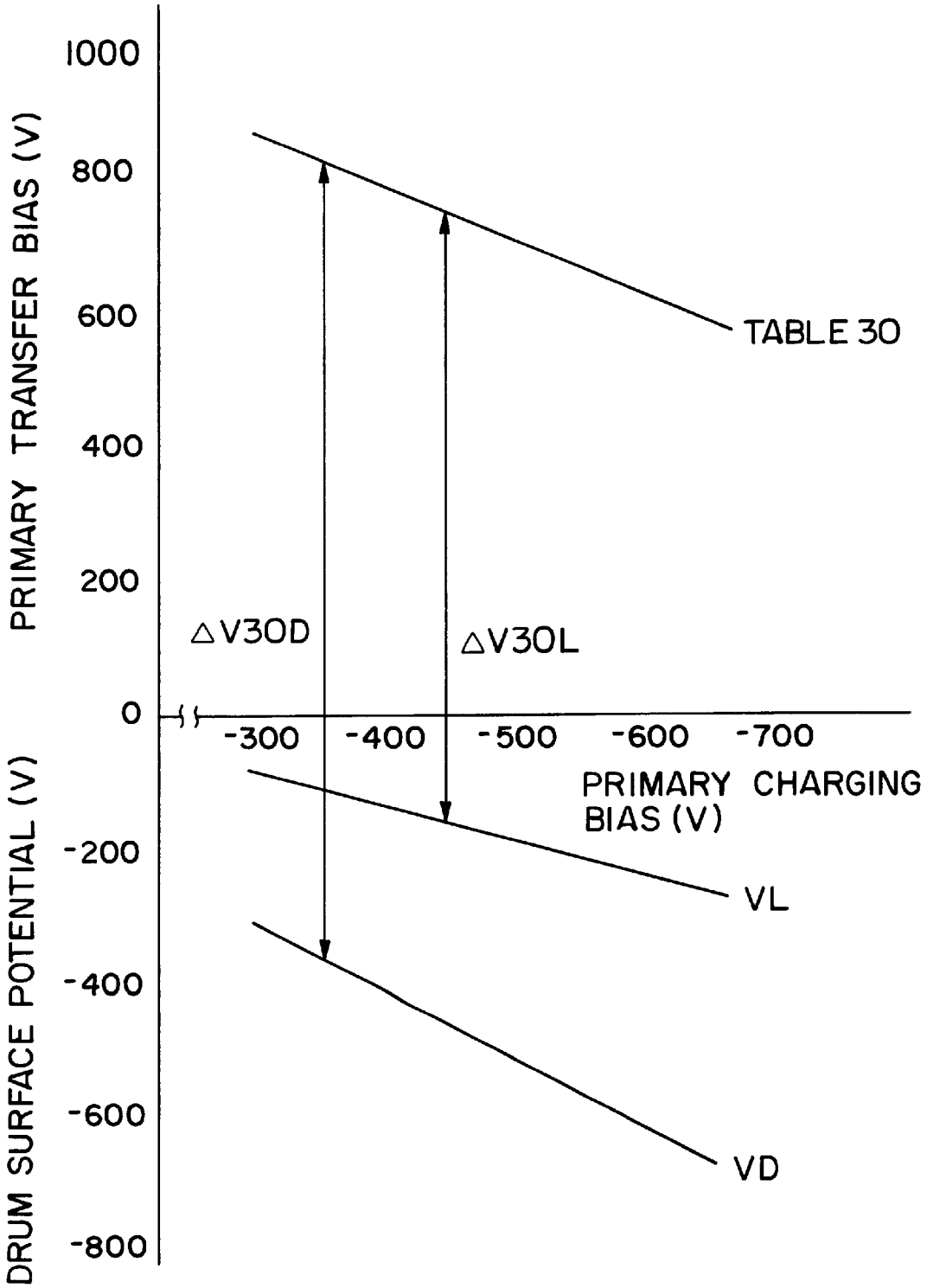
FIG. 8 is a graph which shows the difference among the potential level $V_D$ to which the photosensitive drum 1 is charged, the potential level $V_L$ of an exposed portion of the peripheral surface of the photosensitive drum 1, and the level of the primary transfer bias, in the second embodiment.

More specifically, as described before, the amount of the change which occurs to the potential level $V_D$ when the primary charge bias is changed is different from the amount of the change which occurs to the potential level $V_L$ of the exposed portion when the primary charge bias is changed. Therefore, a primary transfer bias table (Tables 10, 20, 30 and 40), which contains primary transfer bias value that renders substantially constant the difference ($\Delta V10$, $\Delta V20$, $\Delta V30$ and $\Delta V40$) in voltage between the intermediate value between the potential level $V_D$ and the potential level $V_L$ of the exposed portion, and the primary transfer bias, as indicated by the dotted line in FIG. 7, is prepared for each color component. When an image forming apparatus is controlled in accordance with these tables, the difference in voltage $\Delta V30D$ between the primary transfer bias and the potential level $V_D$ of the photosensitive drum 1, and the difference in voltage $\Delta V30L$ between the primary transfer bias and the potential level $V_L$ of the exposed portion, fall within the tolerable range even when the magnitude of the primary charge bias is changed. As a result, the strength of the barrier composed of electrical charge becomes proper for preventing toner from scattering. Consequently, desirable transfer performance is reliably maintained.

The primary transfer bias may be controlled based on the potential level $V_D$ of the peripheral surface of the uniformly charged photosensitive drum I detected by a surface potential sensor 25, and the potential level $V_L$ of the exposed portion detected by a surface potential sensor 26.

Embodiment 3

In the following description of the third embodiment of the present invention, the description will be focused on such characteristics of the third embodiment that render the third embodiment different from the first and second embodiments.

When the primary transfer process is sequentially repeated four times to form a single full-color image, the electrical charge given to the non-image portion of the intermediary transfer belt 5*a* during the first primary transfer process gradually attenuates through the second and third transfer processes. Therefore, in order to prevent toner from scattering, by setting up a proper barrier of electrical charge, the amount of the electrical charge given to the non-image portion of the intermediary transfer belt 5*a* during a transfer process must be adjusted in consideration of the attenuation: the earlier in the order the electrical charge is given to the non-image portion during the transfer process, the greater must be rendered the amount of the electrical charge. As for the latitude in transfer, the later the order, the smaller the latitude.

Thus, in this third embodiment, the primary transfer biases for the first and second color components are set so as to render constant the difference in voltage between the primary transfer bias and the potential level $V_D$, in consideration of the importance of the electrical charge given to the non-image portion during the first and second transfer processes, that is, the transfer processes for the first and second color components, whereas in the cases of the third and fourth color components, emphasis is placed on the transfer performance, and therefore, the primary transfer biases for the third and fourth color components are set so as to render constant the difference in voltage between the transfer bias and the intermediate value between the potential level $V_D$ and the potential level $V_L$ of the exposed portion. With this arrangement, desirable images can always be obtained even in the case of a color image forming apparatus.

Embodiment 4

The fourth embodiment is characterized in that the primary transfer bias for the first color component is not changed even when the primary charge bias is changed.

More specifically, in an image forming operation for continuously forming a plurality of copies, a secondary transfer process is carried out while a primary transfer process is carried out. In this situation, if the electrical resistance of the elastic base layer 22 of the intermediary transfer belt 5*a* is low, the secondary transfer bias applied between the secondary transfer roller 8*b* and the opposing electrode is affected by the primary transfer bias. Thus, if the primary transfer bias for the first color component changes, the secondary transfer bias changes, changing thereby the secondary transfer performance. Consequently, image quality deteriorates.

Figures 9, 10:
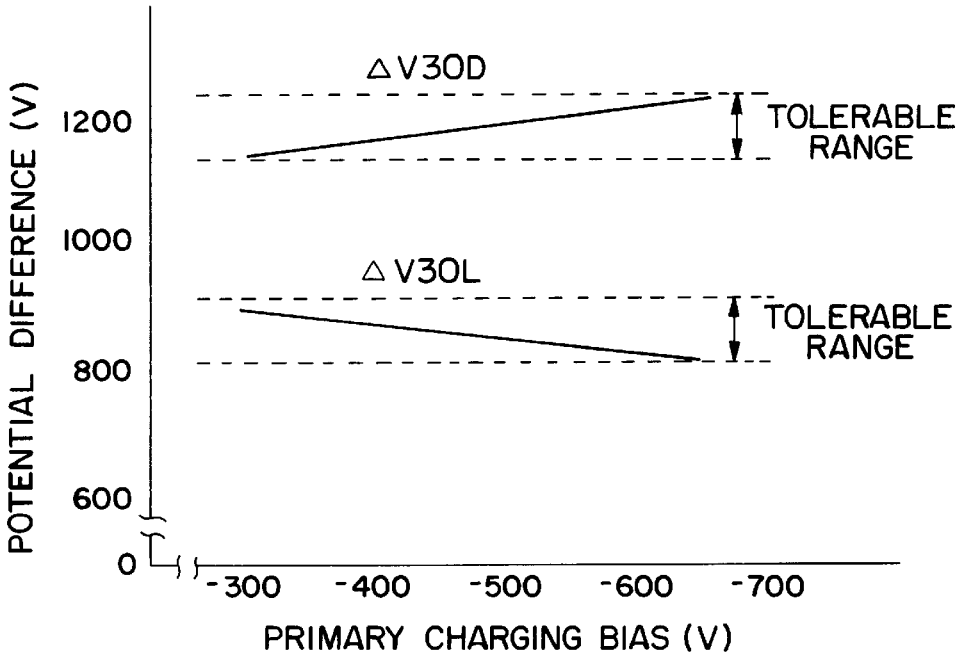
FIG. 9 is a graph which shows the relationship between the potential level $V_D$ to which the photosensitive drum 1 is charged, and its tolerable range, in the second embodiment.
FIG. 10 is a table which shows the relationship between the color order, and the latitude in primary transfer bias, in a color image forming apparatus based on four primary colors.

FIG. 10 shows latitude for the primary transfer bias for each color component. This latitude was obtained by changing the primary transfer bias while keeping the primary charge bias at −500 V.

As is evident from the table, latitude is greatest for the primary transfer bias for the first color component, and gradually decreases toward the last color component. This is due to the following reason. That is, the toner image of the first color component is always transferred onto the intermediary transfer belt 5*a* which has not been covered with toner. However, the toner image of the fourth color component is transferred onto the intermediary transfer belt 5*a* which has been nonuniformly covered with toner; there are areas covered with no toner, areas covered with three layers of different color, and so on, on the intermediary transfer belt 5*a,* and yet, all of these areas of the image must be satisfactorily transferred. Consequently, the latitude afforded for the primary transfer bias for the fourth color component becomes much smaller. Further, in the case of the first color component, the surface potential of the intermediary transfer belt 5*a* prior to the primary transfer process is always stable. However, in the cases of the second color component and thereafter, the amount of attenuation which occurs to the electrical charge cumulatively given to the intermediary transfer belt 5*a* prior to the current primary transfer process changes due to changes in the ambient temperature and humidity, the nonuniformity of the electrical resistance across the intermediary transfer belt 5*a,* and the like, and therefore, the surface potential of the intermediary transfer belt 5*a* prior to the primary transfer process fluctuates, which is one of the reasons why the latitude for the primary transfer bias reduces toward the last color components.

According to this fourth embodiment, the change in the primary charge bias is within a range of −300 V−−650 V. This change of 350 V can be covered by the latitude for the transfer bias for the first color component, and therefore, desirable transfer performance can be maintained even if the magnitude of the primary transfer bias is not changed in accordance with the primary charge bias. In addition, unless the primary transfer bias for the first color component is changed, the potential level of the electrode which opposes the secondary transfer roller 8*b* does not change either. Therefore, the secondary transfer performance is prevented from fluctuating, and consequently, the formation of poor images can be prevented. In other words, according to the fourth embodiment, even if the primary transfer bias changes, the primary and secondary transfer performances are not affected, and therefore, it is possible to always produce desirable images.

Embodiment 5

The subjects discussed in the first to fourth embodiments are also applicable to the image forming apparatus which will be described next with reference to FIG. 11.

Figure 11:
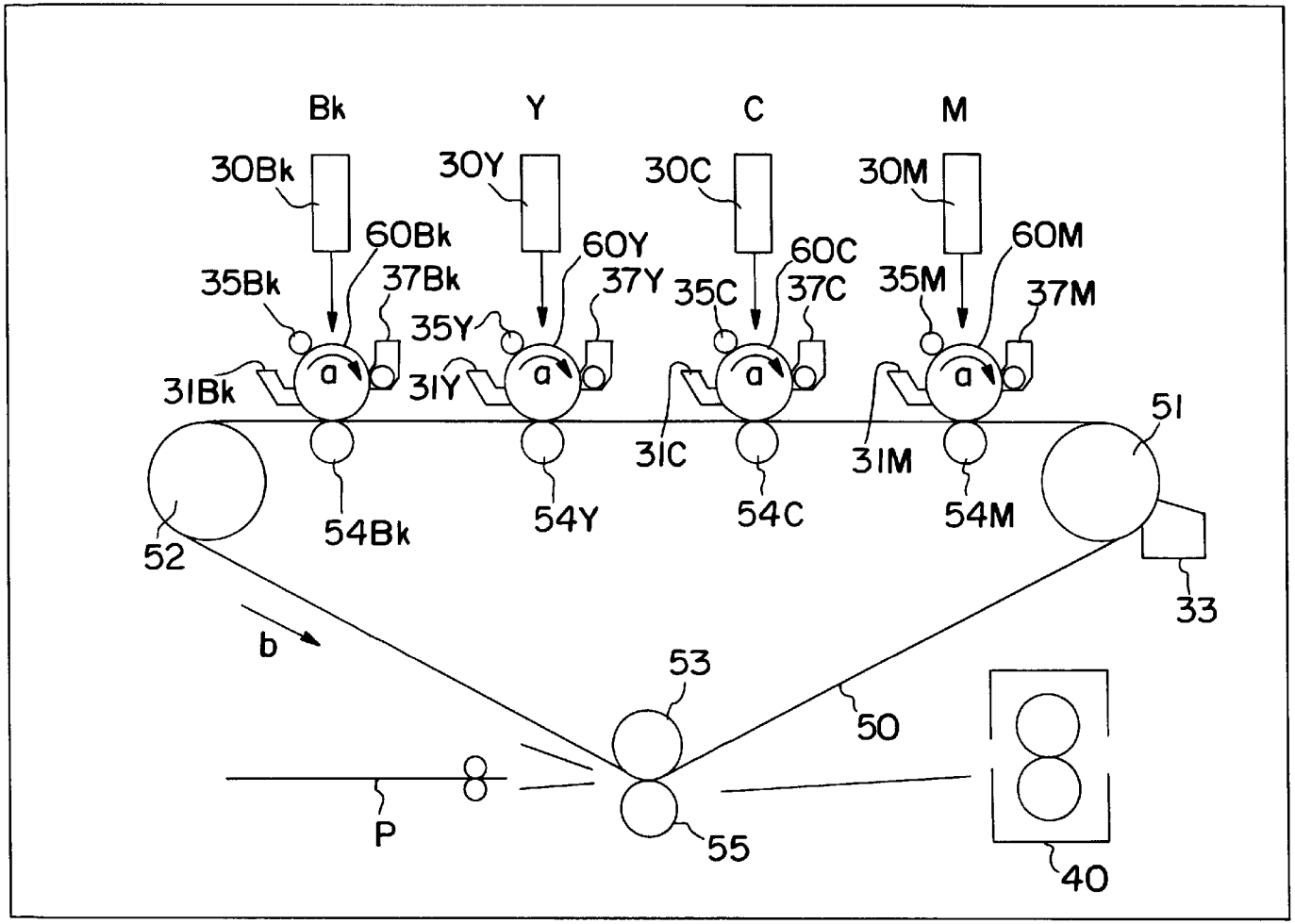
FIG. 11 is a schematic vertical section of the fifth embodiment of the present invention, and depicts the general structure of the apparatus.

FIG. 11 is a schematic section of the image forming apparatus in the fifth embodiment of the present invention, and depicts the general structure of the apparatus.

As shown in the drawing, the image forming apparatus in this embodiment comprises a plurality of image forming units M, C, Y and Bk, through each of which an intermediary transfer belt 50 is put. In each of the image forming units M, C, Y and Bk, a cylindrical photosensitive member (photosensitive drum 60M, 60C, 60Y or 60Bk) as an electrostatic latent image bearing member is supported so that it can be rotated in the direction of an arrow mark a. Referential code 35M, 35C, 35Y or 35Bk designates a primary charger, which is disposed a predetermined gap apart from the correspondent photosensitive drum (60M, 60C, 60Y or 60Bk). Referential code 30M, 30C, 30Y or 30Bk designates a laser based exposing apparatus, which exposes the downstream side, in terms of rotational direction, of the peripheral surface of the photosensitive member (60M, 60C, 60Y or 60Bk), relative to the primary charger (35M, 35C, 35Y or 35Bk). Designated by referential code 37M, 37C, 37Y or 37Bk is a developing device which contains toner (magenta toner, cyan toner, yellow toner or black toner), and is disposed on the downstream side of the exposing apparatus, being in contact with the photosensitive drum.

The intermediary transfer belt 50 is suspended around three rollers, which are a driving roller 51, a tension roller 52, and a counter roller 53. It is driven in the direction of an arrow mark b, in contact with the photosensitive members 60M, 60C, 60Y and 60Bk.

The transfer chargers 54M, 54C, 54Y and 54Bk are disposed so as to pinch the intermediary transfer belt 50 between themselves and the correspondent photosensitive drums. They are arranged, in the order listed above, from the upstream side in terms of the moving direction of the intermediary transfer belt 50. Designated by the referential code 31M, 31C, 31Y or 31Bk is a cleaner for the photosensitive drum, and designated by a referential code 33 is a cleaner for cleaning the intermediary transfer belt 50.

The operation of the image forming apparatus structured as described above will be described with reference to the image forming unit M.

The photosensitive drum 60M comprises an electrically conductive base member formed of aluminum or the like material, and a photosensitive surface layer, and is driven in the direction of an arrow mark a. The peripheral surface of the photosensitive drum 60M is uniformly charged by applying the primary charge bias to the primary charger 35M, and then, is exposed by the laser based exposing apparatus 30M. As a result, an electrostatic latent image is formed on the peripheral surface of the photosensitive drum 60M. The developing device 37M develops the latent image with the use of negatively charged toner, and therefore, a toner image correspondent to the electrostatic latent image is formed on the peripheral surface of the photosensitive drum 60M. Then, the toner image formed on the peripheral surface of the photosensitive drum 60M is transferred onto the intermediary transfer belt 50 by applying the primary transfer bias to the primary transfer roller 54M.

Meanwhile, the photosensitive drum 60M is cleaned of the toner which remains adhering to its peripheral surface, by the cleaner 31M, being prepared for the following image formation.

The above-described operation is individually carried out by each image forming unit, with a predetermined timing, and the toner image formed on each photosensitive drum is sequentially transferred onto the intermediary transfer belt 50. In the full-color mode, the toner images are sequentially transferred in the order of M, C, Y and Bk. Also in the monochrome mode, two color mode, or three color mode, the toner images of the pertinent color components are transferred onto the intermediary transfer belt 50 in the order listed above; the toner images are overlaid on the intermediary transfer belt 50.

The full-color toner image formed on the intermediary transfer belt 50 by sequentially transferring, or overlaying, the four toner images for different color component are transferred all at once onto a transfer medium P delivered by a sheet feeder roller with a predetermined timing, as the secondary transfer bias is applied to a secondary transfer roller 55.

The transfer medium P having received the full-color toner image is sent into a fixing apparatus 40, in which it is subjected to heat and pressure. As a result, a permanent full-color image is obtained.

After the full-color image is transferred from the intermediary transfer belt 50 onto the transfer medium P, the surface of the intermediary transfer belt 50 is cleaned by the cleaner 33.

The present invention is applicable even to the image forming apparatus described above; even in the case of the image forming apparatus described above, the primary transfer bias may be changed in accordance with the primary charge bias. As a result, the strength of the barrier composed of electrical charge given to the non-image portion of the intermediary transfer belt becomes proper, and therefore, even if a plurality of toner images of different color (magenta, cyan, yellow and black colors) are overlaid, toner is prevented from scattering; the formation of images inferior in terms of the correctness of color does not occur.

The various components described in this embodiment are basically the same as those discussed in the first embodiment.

Figure 12:
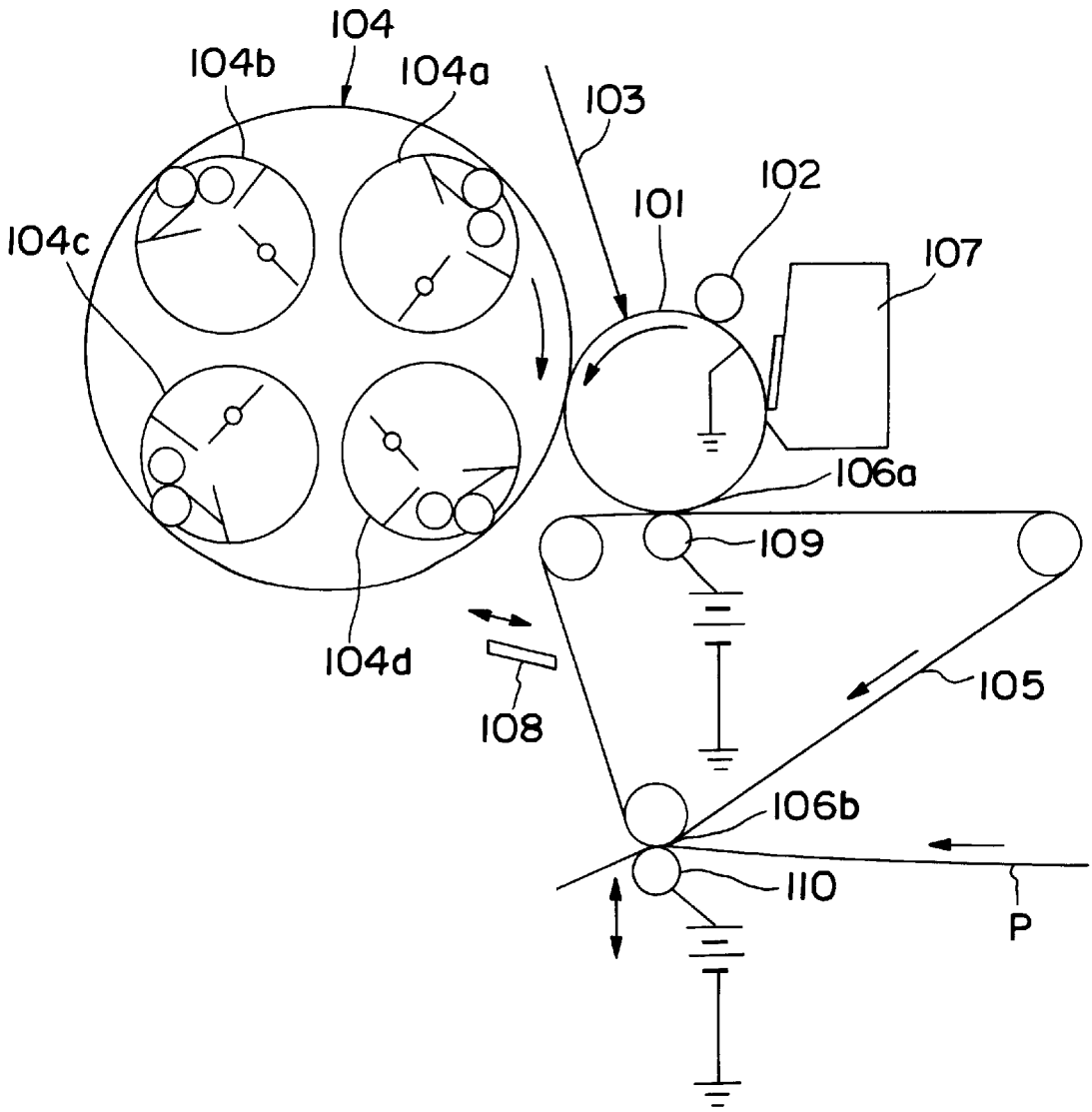
FIG. 12 PRIOR ART
FIG. 12 is a schematic vertical section of a conventional image forming apparatus, and depicts the general structure of the apparatus.

In the first to the fifth embodiments, the magnitude of the primary charge bias was changed in accordance with the changes which occur to the photosensitive drum and the developing devices with the usage of the apparatus (number of recording medium passed through the apparatus), the ambient temperature and humidity, and the like. However, when the primary charge bias is changed in accordance with the change in the development bias, the amount by which the primary charge bias must be changed is greater, and therefore, the effects of the application of the present invention are more prominent. Further, the magnitude of the development bias may be set in accordance with the toner density of the toner image formed on the photosensitive drum or the intermediary transfer belt, which is detected by a reflection type density sensor designated by a referential FIG. 12. In the case of a color image forming apparatus in which the above process is carried out, the magnitude of the development bias is frequently changed, and accordingly, the magnitude of the primary charge bias is also frequently changed, requiring more control for the formation of high quality images. Therefore, the effects of the present invention are more conspicuous when applied to such an apparatus.

While the invention has been described with reference to the structures disclosed herein, it is not confirmed to the details set forth and this application is intended to cover such modifications or changes as may come within the purposes of the improvements or the scope of the following claims.

What is claimed is:

1. An image forming apparatus comprising:

an image bearing member;

image forming means for sequentially forming toner images of different colors on said image bearing member, said image forming means including a charging member for electrically charging said image bearing member to a polarity which is the same as a regular charging polarity of the toner;

an intermediary transfer member having a volume resistivity of $10^{10}$–$10^{16}\Omega\cdot$cm;

image transferring means for applying a voltage to said intermediary transfer member to transfer electrostatically, sequentially and superimposedly the toner images of the different colors formed on said image bearing member by said image forming means onto said intermediary transfer member, wherein toner images on said intermediary transfer member are transferred onto a transfer material; and control means for controlling a voltage applied to said charging member, said control means controlling the voltage applied to said intermediary transfer member by said image transferring means in accordance with the voltage applied to said charging member.

2. An apparatus according to claim 1, further comprising detecting means for detecting a density of a toner image formed on said image bearing member or the toner image transferred onto said intermediary transfer member, wherein said control means controls the voltage applied to said charging member in accordance with a detection result of said detecting means.

3. An apparatus according to claim 1, further comprising detecting means for detecting a temperature and a humidity in a main assembly of said apparatus, wherein said control means controls the voltage applied to said charging member in accordance with a detection result of said detecting means.

4. An apparatus according to claim 1, further comprising second transferring means for electrostatically transferring the toner images of different colors transferred onto said intermediary transfer member, onto a transfer material, wherein said second transferring means is contacted to the transfer material during image transfer operation.

5. An apparatus according to claim 4, wherein said intermediary transfer member has an electroconductive layer, and the transfer of the toner images of different colors from said intermediary transfer member onto the transfer material, and the transfer of a toner image of a next first color from said image bearing member onto said intermediary transfer member, are capable of being carried out simultaneously.

6. An apparatus according to claim 5, wherein when the toner image of the next first color is transferred from said image bearing member onto said intermediary transfer member, a predetermined voltage irrespective of the voltage applied to said charging member is applied to said intermediary transfer member by said image transferring means.

7. An apparatus according to claim 1, wherein said control means provides different potential differences between the voltage applied to said charging member and the voltage applied to said intermediary transfer member by said image transferring means, for different colors.

8. An apparatus according to claim 1, wherein said intermediary transfer member includes an elastic layer having a volume resistivity of $10^{3}$–$10^{8}\Omega$cm and a dielectric layer thereon having a volume resistivity of $10^{10}$–$10^{16}\Omega$cm.

9. An apparatus according to claim 8, wherein said intermediary transfer member includes said elastic layer having a volume resistivity of $10^{6}$–$10^{7}\Omega$cm and said dielectric layer thereon having a volume resistivity of $10^{13}$–$10^{14}\Omega$cm.

10. An apparatus according to claim 1, wherein said intermediary transfer member is in the form of a belt.

11. An apparatus according to claim 1, wherein said image transferring means is provided with a voltage source for applying a voltage to said intermediary transfer member.

12. An apparatus according to claim 11, wherein said image transferring means includes a roller contactable to said intermediary transfer member.

13. An apparatus according to any one of claims 1 to 12, wherein said control means controls the voltage applied to said charging member for each color of the toner.

14. An image forming apparatus comprising:

an image bearing member;

image forming means for sequentially forming toner images of different colors on said image bearing member, said image forming means including a charging member for electrically charging said image bearing member to a polarity which is the same as a regular charging polarity of the toner;

an intermediary transfer member having a volume resistivity of $10^{10}$–$10^{16}\Omega\cdot$cm;

image transferring means for applying a voltage to said intermediary transfer member to transfer electrostatically, sequentially and superimposedly the toner images of the different colors formed on said image bearing member by said image forming means onto said intermediary transfer member, wherein toner images on said intermediary transfer member are transferred onto a transfer material; and control means for controlling the voltage applied to said charging member for each color of the toner;

wherein said control means controls differences between surface potentials of said image bearing member and the voltage applied to said intermediary transfer member from said image transfer means so as to provide differences between surface potentials which are different depending on the colors.

15. An apparatus according to claim 14, further comprising detecting means for detecting a density of a toner image formed on said image bearing member or the toner image transferred onto said intermediary transfer member, wherein said control means controls the voltage applied to said charging member in accordance with a detection result of said detecting means.

16. An apparatus according to claim 14, further comprising detecting means for detecting a temperature and a humidity in a main assembly of said apparatus, wherein said control means controls the voltage applied to said charging member in accordance with a detection result of said detecting means.

17. An apparatus according to claim 14, further comprising second transferring means for electrostatically transferring the toner images of different colors transferred onto said intermediary transfer member, onto the transfer material, wherein said second transferring means is contacted to the transfer material during image transfer operation.

18. An apparatus according to claim 17, wherein said intermediary transfer member has an electroconductive layer, and the transfer of the toner images of different colors from said intermediary transfer member onto the transfer material, and the transfer of a toner image of a next first color from said image bearing member onto said intermediary transfer member, are capable of being carried out simultaneously.

19. An apparatus according to claim 18, wherein when the toner image of the next first color is transferred from said image bearing member onto said intermediary transfer member, a predetermined voltage irrespective of the voltage applied to said charging member is applied to said intermediary transfer member by said image transferring means.

20. An apparatus according to claim 14, wherein said intermediary transfer member includes an elastic layer having a volume resistivity of $10^3$–$10^8\Omega$cm and a dielectric layer thereon having a volume resistivity of $10^{10}$–$10^{16}\Omega$cm.

21. An apparatus according to claim 20, wherein said intermediary transfer member includes said elastic layer having a volume resistivity of $10^6$–$10^7\Omega$cm and said dielectric layer thereon having a volume resistivity of $10^{13}$–$10^{14}\Omega$cm.

22. An apparatus according to claim 14, wherein said intermediary transfer or is in the form of a belt.

23. An apparatus according to claim 14, wherein said image forming means is provided with an exposure device for exposing the surface of said image bearing member having been charged by said charging member.

24. An apparatus according to claim 23, further comprising detecting means for detecting a light portion potential on the surface of said image bearing member exposed by said exposure device, wherein said control means controls the voltage applied to said intermediary transfer member by said image transferring means in accordance with a detection result of said detecting means.

25. An apparatus according to claim 24, wherein said control means controls the voltage applied to said intermediary transfer member by said image transferring means in accordance with a predetermined potential between the charged potential and the light portion potential.

26. An apparatus according to claim 14, further comprising a detecting means for detecting the charged potential of the surface of said image bearing member.

27. An image forming apparatus comprising:

an image bearing member;

image forming means for sequentially forming toner images of different colors on said image bearing member, said image forming means including a charging member for electrically charging said image bearing member to a polarity which is the same as a regular charging polarity of the toner;

an intermediary transfer member having a volume resistivity of $10^{10}$–$10^{16}\Omega\cdot$cm;

image transferring means for applying a voltage to said intermediary transfer member to transfer electrostatically, sequentially and superimposedly the toner images of the different colors formed on said image bearing member by said image forming means onto said intermediary transfer member, wherein toner images on said intermediary transfer member are transferred onto a transfer material; and control means for controlling a voltage applied to said charging member, wherein said control means controls to provide a substantially constant difference between the voltage applied to said charging member and the voltage applied to said intermediary transfer member by said image transferring means even when the voltage applied to said charging member is changed.

28. An apparatus according to claim 27, further comprising detecting means for detecting a density of a toner image formed on said image bearing member or the toner image transferred onto said intermediary transfer member, wherein said control means controls the voltage applied to said charging member in accordance with a detection result of said detecting means.

29. An apparatus according to claim 27, further comprising detecting means for detecting a temperature and a humidity in a main assembly of said apparatus, wherein said control means controls the voltage applied to said charging member in accordance with a detection result of said detecting means.

30. An apparatus according to claim 27, further comprising second transferring means for electrostatically transferring the toner images of different colors transferred onto said intermediary transfer member, onto the transfer material, wherein said second transferring means is contacted to the transfer material during image transfer operation.

31. An apparatus according to claim 30, wherein said intermediary transfer member has an electroconductive layer, and the transfer of the toner images of different colors from said intermediary transfer member onto a transfer material, and the transfer of a toner image of a next first color from said image bearing member onto said intermediary transfer member, are capable of being carried out simultaneously.

32. An apparatus according to claim 31, wherein when said toner image of the next first color is transferred from said image bearing member onto said intermediary transfer member, a predetermined voltage irrespective of the voltage applied to said charging member is applied to said intermediary transfer member by said image transferring means.

33. An apparatus according to claim 27, wherein said control means provides different potential differences between the voltage applied to said charging member and the voltage applied to said intermediary transfer member by said image transferring means, for different colors.

34. An apparatus according to claim 27, wherein said intermediary transfer member includes an elastic layer having a volume resistivity of $10^3$–$10^8\Omega$cm and a dielectric layer thereon having a volume resistivity of $10^{10}$–$10^{16}\Omega$cm.

35. An apparatus according to claim 34, wherein said intermediary transfer member includes said elastic layer having a volume resistivity of $10^6$–$10^7\Omega\cdot$cm and said dielectric layer thereon having a volume resistivity of $10^{13}$–$10^{14}\Omega\cdot$cm.

36. An apparatus according to claim 27, wherein said intermediary transfer member is in the form of a belt.

37. An apparatus according to claim 27, wherein said image transfering means is provided with a voltage source for applying a voltage to said intermediary transfer member.

38. An apparatus according to claim 27, wherein said image transferring means includes a roller contactable to said intermediary transfer member.

39. An apparatus according to any one of claims 27 to 38, wherein said control means controls the voltage applied to said charging member for each color of the toner.

40. An image forming apparatus comprising:

a first image bearing member;

first image forming means for forming a toner image on said first image bearing member, said first image forming means including a first charging member for electrically charging said first image bearing member to a polarity which is the same as a regular charging polarity of the toner;

a second image bearing member;

second image forming means for forming a toner image on said second image bearing member, said second image forming means including a second charging member for electrically charging said second image bearing member to a polarity which is the same as a regular charging polarity of the toner;

an intermediary transfer member having a volume resistivity of $10^{10}$–$10^{16}\Omega\cdot$cm;

first image transferring means for applying a voltage to said intermediary transfer member to transfer electrostatically the toner image formed on said first image bearing member by said first image forming means onto said intermediary transfer member;

second image transferring means for applying a voltage to said intermediary transfer member to transfer electrostatically and superimposedly the toner image formed on said second image bearing member by said second image forming means onto said intermediary transfer member having the toner image transferred by said first image transferring means;

wherein toner images transferred by said first and second image transferring means onto said intermediary transfer member are transferred onto a transfer material; and control means for controlling voltages applied to said first and second charging member, said control means controlling the voltage applied to said intermediary transfer member by said first and second image transferring means in accordance with the voltages applied to said first and second charging members, respectively.

41. An apparatus according to claim 40, further comprising detecting means for detecting a density of a toner image formed on said first and second image bearing members or the toner image transferred onto said intermediary transfer member by said first and second image transferring means, wherein said control means controls the voltages applied to said first and second charging members in accordance with a detection result of said detecting means.

42. An apparatus according to claim 40, further comprising detecting means for detecting a temperature and a humidity in a main assembly of said apparatus, wherein said control means controls the voltages applied to said first and second charging members in accordance with a detection result of said detecting means.

43. An apparatus according to claim 40, further comprising third transferring means for electrostatically transferring the toner images transferred onto said intermediary transfer member, onto the transfer material, wherein said third transferring means is contacted to the transfer material during image transfer operation.

44. An apparatus according to claim 43, wherein said intermediary transfer member has an electroconductive layer, and the transfer of the toner image from said intermediary transfer member onto a transfer material, and the transfer of a toner image from said first image bearing member onto said intermediary transfer member, are capable of being carried out simultaneously.

45. An apparatus according to claim 44, wherein when the toner image is transferred from said first image bearing member onto said intermediary transfer member, a predetermined voltage irrespective of the voltage applied to said first charging member is applied to said intermediary transfer member by said first image transferring means.

46. An apparatus according to claim 40, wherein said control means provides a difference between a potential difference between the voltage applied to said first charging member and the voltage applied to said intermediary transfer member by said first image transferring means and a potential difference between the voltage applied to said second charging member and the voltage applied to said intermediary transfer member by said second image transferring means.

47. An apparatus according to claim 40, wherein said intermediary transfer member includes an elastic layer having a volume resistivity of $10^3$–$10^8\Omega\cdot$cm and a dielectric layer thereon having a volume resistivity of $10^{10}$–$10^{16}\Omega\cdot$cm.

48. An apparatus according to claim 47, wherein said intermediary transfer member includes said elastic layer having a volume resistivity of $10^6$–$10^7\Omega\cdot$cm and said dielectric layer thereon having a volume resistivity of $10^{13}$–$10^{14}\Omega\cdot$cm.

49. An apparatus according to claim 40, wherein said intermediary transfer member is a belt.

50. An apparatus according to claim 40, wherein said first and second image transferring means is provided with voltage source means for applying voltages to said intermediary transfer member.

51. An apparatus according to claim 50, wherein said first and second image transferring means include rollers contactable to said intermediary transfer member.

52. An apparatus according to claim 40, wherein the toner images formed by said first image forming means and said second image forming means on said first image bearing member and said second image bearing member are sequentially and superimposedly transferred onto the intermediary transfer member.

53. An apparatus according to claim 52, wherein a color of the toner image formed on said first image bearing member by said first image forming means is different from a color of the toner image formed on said second image bearing member by said second image forming means.

54. An image forming apparatus comprising:

a first image bearing member;

first image forming means for forming a toner image on said first image bearing member, said first image forming means including a first charging member for electrically charging said first image bearing member to a polarity which is the same as a regular charging polarity of the toner;

a second image bearing member;

second image forming means for forming a toner image on said second image bearing member, said second image forming means including a second charging member for electrically charging said second image bearing member to a polarity which is the same as a regular charging polarity of the toner;

an intermediary transfer member having a volume resistivity of $10^{10}$–$10^{16}\Omega\cdot$cm;

first image transferring means for applying a voltage to said intermediary transfer member to transfer electrostatically the toner image formed on said first image bearing member by said first image forming means onto said intermediary transfer member;

second image transferring means for applying a voltage to said intermediary transfer member to transfer electrostatically and superimposedly the toner image formed on said second image bearing member by said second image forming means onto said intermediary transfer member having the toner image transferred by said first image transferring means;

wherein toner images transferred by said first and second image transferring means onto said intermediary transfer member are transferred onto a transfer material; and control means for controlling the voltages applied to said intermediary transfer member by said first and second image transferring means in accordance with surface potentials of said first and second image bearing members, respectively.

55. An apparatus according to claim 54, further comprising detecting means for detecting a density of a toner image formed on said first and second image bearing members or the other image transferred onto said intermediary transfer member by said first and second image transferring means, wherein said control means controls the voltages applied to said first and second charging members in accordance with a detection result of said detecting means.

56. An apparatus according to claim 54, further comprising detecting means for detecting a temperature and a humidity in a main assembly of said apparatus, wherein said control means controls the voltages applied to said first and second charging members in accordance with a detection result of said second detecting means.

57. An apparatus according to claim 54, further comprising third transferring means for electrostatically transferring the toner images transferred the toner images transferred onto said intermediary transfer member, onto the transfer material, wherein said third transferring means is contacted to the transfer material during image transfer operation.

58. An apparatus according to claim 57, wherein said intermediary transfer member has an electroconductive layer, and the transfer of the toner image from said intermediary transfer member onto a transfer material, and the transfer of a toner image from said first image bearing member onto said intermediary transfer member, are capable of being carried out simultaneously.

59. An apparatus according to claim 58, wherein when the toner image is transferred from said first image bearing member onto said intermediary transfer member, a predetermined voltage irrespective of the voltage applied to said first charging member is applied to said intermediary transfer member by said first image transferring means.

60. An apparatus according to claim 54, wherein said control means provides a difference between a potential difference between the voltage applied to said first charging member and the voltage applied to said intermediary transfer member by said first image transferring means and a potential difference between the voltage applied to said second charging member and the voltage applied to said intermediary transfer member by said second image transferring means.

61. An apparatus according to claim 54, wherein said intermediary transfer member includes an elastic layer having a volume resistivity of $10^{3}$–$10^{8}\Omega\cdot$cm and a dielectric layer thereon having a volume resistivity of $10^{10}$–$10^{16}\Omega\cdot$cm.

62. An apparatus according to claim 61, wherein said intermediary transfer member includes said elastic layer having a volume resistivity of $10^{6}$–$10^{7}\Omega\cdot$cm and said dielectric layer thereon having a volume resistivity of $10^{13}$–$10^{14}\Omega\cdot$cm.

63. An apparatus according to claim 54, wherein said intermediary transfer member is a belt.

64. An apparatus according to claim 54, wherein said first and second image transferring means is provided with voltage source means for applying voltages to said intermediary transfer member.

65. An apparatus according to claim 54, wherein said first and second image transferring means include rollers contactable to said intermediary transfer member.

66. An apparatus according to claim 54, wherein the toner images formed by said first image forming means and said second image forming means on said first image bearing member and said second image bearing member are sequentially and superimposedly transferred onto the intermediary transfer member.

67. An apparatus according to claim 66, wherein a color of the toner image formed on said first image bearing member by said first image forming means is different from a color of the toner image formed on said second image bearing member by said second image forming means.

68. An image forming apparatus comprising:

a first image bearing member;

first image forming means for forming a toner image on said first image bearing member, said first image forming means including a first charging member for electrically charging said first image bearing member to a polarity which is the same as a regular charging polarity of the toner;

a second image bearing member;

second image forming means for forming a toner image on said second image bearing member, said second image forming means including a second charging member for electrically charging said second image bearing member to a polarity which is the same as a regular charging polarity of the toner;

an intermediary transfer member having a volume resistivity of $10^{10}$–$10^{16}\Omega\cdot$cm;

first image transferring means for applying a voltage to said intermediary transfer member to transfer electrostatically the toner image formed on said first image bearing member by said first image forming means onto said intermediary transfer member;

second image transferring means for applying a voltage to said intermediary transfer member to transfer electrostatically and superimposedly the toner image formed on said second image bearing member by said second image forming means onto said intermediary transfer member having the toner image transferred by said first image transferring means;

wherein toner images transferred by said first and second image transferring means onto said intermediary transfer member are transferred onto a transfer material; and control means for controlling voltages applied to said first and second charging members, wherein said control means controls to provide a substantially constant difference between the voltage applied to said first charging member and the voltage applied to said intermediary transfer member by said first image transferring means and a substantially constant difference between the voltage applied to said second charging member and the voltage applied to said intermediary transfer member by said second image transferring means, even when the voltage applied to said first or second charging member is changed.

69. An apparatus according to claim 68, further comprising detecting means for detecting a density of a toner image formed on said first and second image bearing members or the toner image transferred onto said intermediary transfer member by said first and second image transferring means, wherein said control means controls the voltages applied to said first and second charging members in accordance with a detection result of said detecting means.

70. An apparatus according to claim 68, further comprising detecting means for detecting a temperature and a humidity in a main assembly for said apparatus, wherein said control means controls the voltages applied to said first and second charging members in accordance with a detection result of said second detecting means.

71. An apparatus according to claim 68, further comprising third transferring means for electrostatically transferring the toner images transferred onto said intermediary transfer member, onto the transfer material, wherein said third transferring means is contacted to the transfer material during image transfer operation.

72. An apparatus according to claim 71, wherein said intermediary transfer member has an electroconductive layer, and the transfer of the toner image from said intermediary transfer member onto the transfer material, and the transfer of a toner image from said first image bearing member onto said intermediary transfer member, are capable of being carried out simultaneously.

73. An apparatus according to claim 72, wherein when the toner image is transferred from said first image bearing member onto said intermediary transfer member, a predetermined voltage irrespective of the voltage applied to said first charging member is applied to said intermediary transfer member by said first image transferring means.

74. An apparatus according to claim 68, wherein said control means provides a difference between a potential difference between the voltage applied to said first charging member and the voltage applied to said intermediary transfer member by said first image transferring means and a potential difference between the voltage applied to said second charging member and the voltage applied to said intermediary transfer member by said second image transferring means.

75. An apparatus according to claim 68, wherein said intermediary transfer member includes an elastic layer having a volume resistivity of $10^3$–$10^8\Omega\cdot$cm and a dielectric layer thereon having a volume resistivity of $10^{10}$–$10^{16}\Omega\cdot$cm.

76. An apparatus according to claim 75, wherein said intermediary transfer member includes said elastic layer having a volume resistivity of $10^6$–$10^7\Omega\cdot$cm and said dielectric layer thereon having a volume resistivity of $10^{13}$–$10^{14}\Omega\cdot$cm.

77. An apparatus according to claim 68, wherein said intermediary transfer member is a belt.

78. An apparatus according to claim 68, wherein said first and second image transferring means is provided with voltage source means for applying voltages to said intermediary transfer member.

79. An apparatus according to claim 68, wherein said first and second image transferring means includes rollers contactable to said intermediary transfer member.

80. An apparatus according to claim 68, wherein the toner images formed by said first image forming means and said second image forming means on said first image bearing member and said second image bearing member are sequentially and superimposedly transferred onto the intermediary transfer member.

81. An apparatus according to claim 80, wherein a color of the toner image formed on said first image bearing member by said first image forming means is different from a color of the toner image formed on said second image bearing member by said second image forming means.

* * * * *

UNITED STATES PATENT AND TRADEMARK OFFICE

CERTIFICATE OF CORRECTION

PATENT NO. : 6,226,469 B1
DATED : May 1, 2001
INVENTOR(S) : Takehiko Suzuki et al.

It is certified that error appears in the above-identified patent and that said Letters Patent is hereby corrected as shown below:

Drawings,
Sheet 8, Figure 10, "IRY" shoud read -- PRIMARY --.

Column 3,
Line 60, "an" should read -- and --.

Column 4,
Line 59, "an an" should read -- and an --.

Column 5,
Line 33, "method;" should read -- method: --.

Column 13,
Line 56, "or" should read -- member --.

Column 15,
Line 18, "transfering" should read -- transferring --.

Column 16,
Line 51, "is" should read -- are --.

Column 17,
Line 52, "second" should be deleted; and
Line 55, "the toner images transferred" (second occurrence) should be deleted.

Column 18,
Line 27, "is" should read -- are --.

UNITED STATES PATENT AND TRADEMARK OFFICE

CERTIFICATE OF CORRECTION

PATENT NO. : 6,226,469 B1
DATED : May 1, 2001
INVENTOR(S) : Takehiko Suzuki et al.

It is certified that error appears in the above-identified patent and that said Letters Patent is hereby corrected as shown below:

Column 19,
Line 34, "second" should be deleted.

Signed and Sealed this

Second Day of April, 2002

*Attest:*

*Attesting Officer*

JAMES E. ROGAN
*Director of the United States Patent and Trademark Office*